US010556154B1

(12) United States Patent
Maresh

(10) Patent No.: US 10,556,154 B1
(45) Date of Patent: Feb. 11, 2020

(54) YOGA BALL PADDLEBOARD

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 15/650,843

(22) Filed: Jul. 14, 2017

Related U.S. Application Data

(63) Continuation-in-part of application No. 14/977,630, filed on Dec. 21, 2015, now abandoned.
(Continued)

(51) Int. Cl.
*A63B 22/16* (2006.01)
*A63B 43/04* (2006.01)
(Continued)

(52) U.S. Cl.
CPC ..... *A63B 43/04* (2013.01); *A63B 23/03525* (2013.01); *A63B 26/003* (2013.01);
(Continued)

(58) Field of Classification Search
CPC ... A63B 22/20; A63B 22/185; A63B 23/1236; A63B 26/003; A63B 26/006; A63B 21/068; A63B 21/4027; A63B 21/4033; A63B 21/4034; A63B 21/4035; A63B 22/0046; A63B 22/14; A63B 22/16; A63B 22/18; A63B 2022/185; A63B 23/03516; A63B 23/03525; A63B 23/0355; A63B 23/04; A63B 23/0405; A63B 23/0482; A63B 23/0494; A63B 23/12; A63B 23/1209; A63B 23/1245; A63B 23/1281; A63B 2023/0411; A63B 26/00; A63B 2026/006; A63B 31/00; A63B 31/08; A63B 31/10; A63B 31/12; A63B 35/00; A63B 35/08; A63B 35/10; A63B 41/00; A63B 2041/005; A63B 43/00; A63B 43/04; A63B 47/00; A63B 69/0073; A63B 69/0091; A63B 69/10; A63B 69/14; A63B 2208/0204; A63B 2208/0209; A63B 2208/0214; A63B 2208/0219; A63B 2208/0223; A63B 2208/0228; A63B 2208/0242; A63B 2208/0252; A63B 2208/0257; A63B 2208/0295;
(Continued)

(56) References Cited

U.S. PATENT DOCUMENTS 2,457,759 A * 12/1948 Wales ..... A63B 57/357 473/176
3,430,958 A * 3/1969 Lakeman ..... A63B 63/08 273/400
(Continued)

*Primary Examiner* — Gary D Urbiel Goldner
(74) *Attorney, Agent, or Firm* — Nick A. Nichols, Jr.

(57) ABSTRACT

A yoga paddleboard may include a yoga board body having a hole extending therethrough. The hole may be formed at the approximate lateral and longitudinal center of the paddleboard. The hole may be sized and configured to support a yoga ball pressed in the hole to establish an interfacing friction connection therebetween. The yoga ball may be used to perform yoga exercises while floating on the paddleboard. Alternative embodiments may include yoga ball supports configured to support yoga balls of different sizes and/or multiple yoga balls for use with the paddleboard.

5 Claims, 7 Drawing Sheets

Related U.S. Application Data

(60) Provisional application No. 62/493,765, filed on Jul. 14, 2016, provisional application No. 62/124,451, filed on Dec. 19, 2014.

(51) Int. Cl.

| | |
|---|---|
| ***A63B 35/10*** | (2006.01) |
| ***A63B 23/035*** | (2006.01) |
| ***A63B 26/00*** | (2006.01) |
| ***A63B 41/00*** | (2006.01) |
| ***A63B 47/00*** | (2006.01) |

(52) U.S. Cl.
CPC ..... *A63B 35/10* (2013.01); *A63B 47/00* (2013.01); *A63B 2041/005* (2013.01); *A63B 2208/0204* (2013.01); *A63B 2208/0242* (2013.01); *A63B 2225/605* (2013.01)

(58) Field of Classification Search
CPC ..... A63B 2208/03; A63B 2225/09; A63B 2225/093; A63B 2225/60; A63B 2225/605; A63B 2225/62; B63C 9/08
See application file for complete search history.

(56) References Cited

U.S. PATENT DOCUMENTS 3,469,844 A * 9/1969 Sindelar ..... A63B 63/083 273/350
3,582,078 A * 6/1971 Katras ..... A63B 63/08 273/394
3,814,439 A * 6/1974 Simon ..... A63B 57/357 473/196
3,941,384 A * 3/1976 Wopschall ..... A63B 63/08 273/386
4,149,719 A * 4/1979 Wakefield ..... A63B 57/357 473/176
5,320,568 A * 6/1994 Koerkel, Jr. ..... B63C 9/08 441/129
6,004,219 A * 12/1999 Peabody ..... A63B 67/02 473/157
6,629,899 B2 * 10/2003 Chauvet ..... A63B 63/08 473/466
7,464,937 B1 * 12/2008 Maggio ..... A63B 63/008 273/350
7,611,427 B1 * 11/2009 Cline ..... A63B 5/11 473/459
7,748,722 B2 * 7/2010 Kane ..... A63B 69/0093 280/14.22
9,339,677 B2 * 5/2016 Kramer ..... A63C 17/0093
9,415,292 B2 * 8/2016 Reino ..... A63B 69/3676
2002/0098899 A1 * 7/2002 Newcomb ..... A63B 67/007 473/157
2004/0087421 A1 * 5/2004 Lin ..... A63B 21/0004 482/146
2004/0102260 A1 * 5/2004 Chia ..... A63B 63/083 473/472
2004/0142801 A1 * 7/2004 Lin ..... A63B 21/0004 482/142
2004/0221885 A1 * 11/2004 Zheng ..... A63B 9/00 135/126
2005/0101204 A1 * 5/2005 Zhao ..... A63B 31/00 441/108
2006/0025029 A1 * 2/2006 Berenson ..... B63C 9/08 441/129
2006/0252601 A1 * 11/2006 Baum ..... A47C 4/54 482/9
2009/0005187 A1 * 1/2009 Schechter ..... A63B 21/00047 472/134
2009/0017707 A1 * 1/2009 Arias ..... B63B 3/08 441/129
2009/0069129 A1 * 3/2009 McCarthy ..... A63B 24/0021 473/476
2009/0215342 A1 * 8/2009 Sannes ..... A63B 22/18 441/74
2013/0252217 A1 * 9/2013 Grzesiak ..... A63B 26/003 434/258
2013/0316886 A1 * 11/2013 Lynch ..... A63B 26/003 482/146
2014/0011603 A1 * 1/2014 Pennington ..... A63B 69/3661 473/278

* cited by examiner

Fig. 1
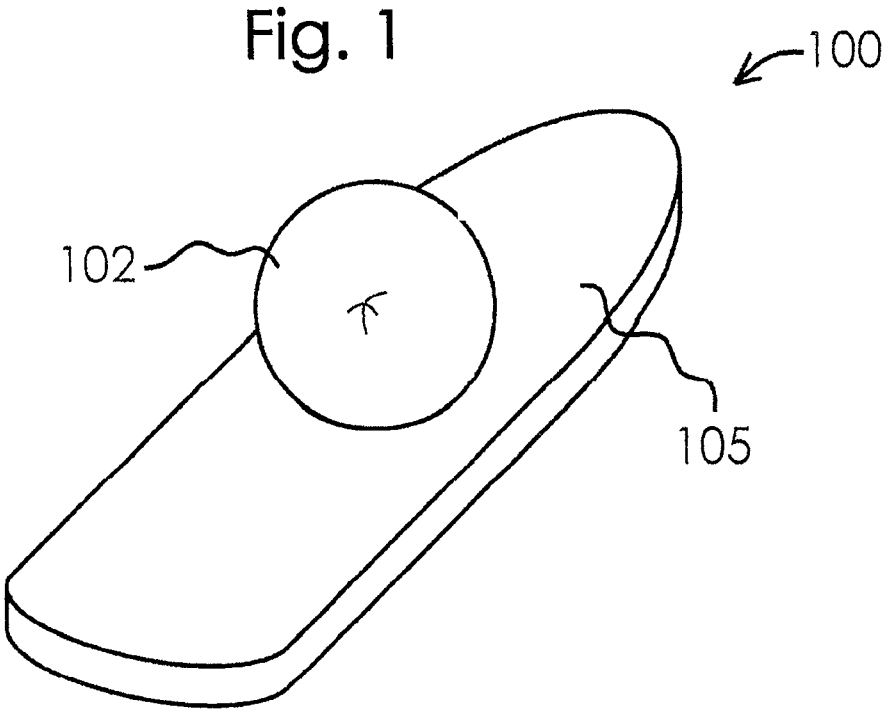
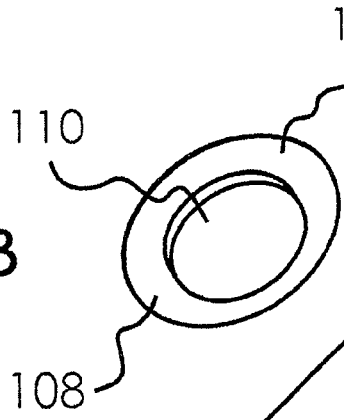
Fig. 2B
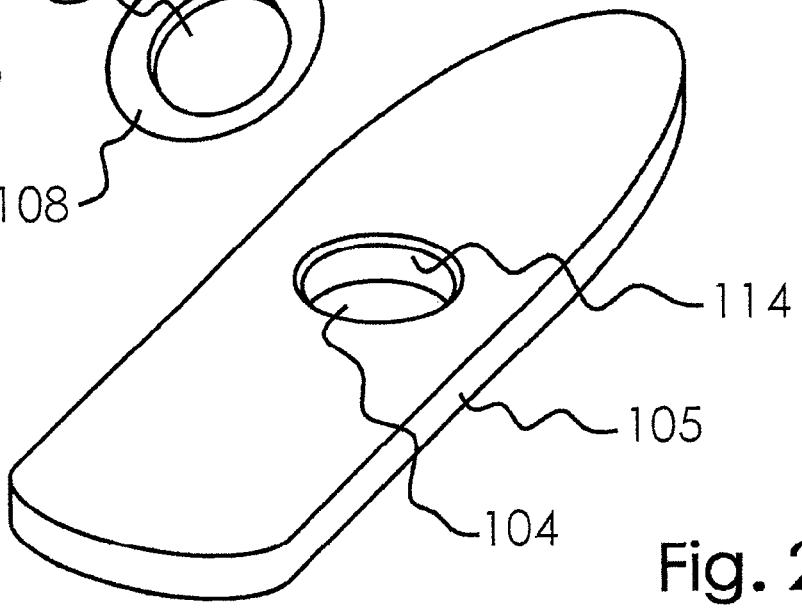
Fig. 2A

220

218
200

216
205
213
214
219
212
210
204
211

219
212
212
209
207
219
210

Fig. 4A
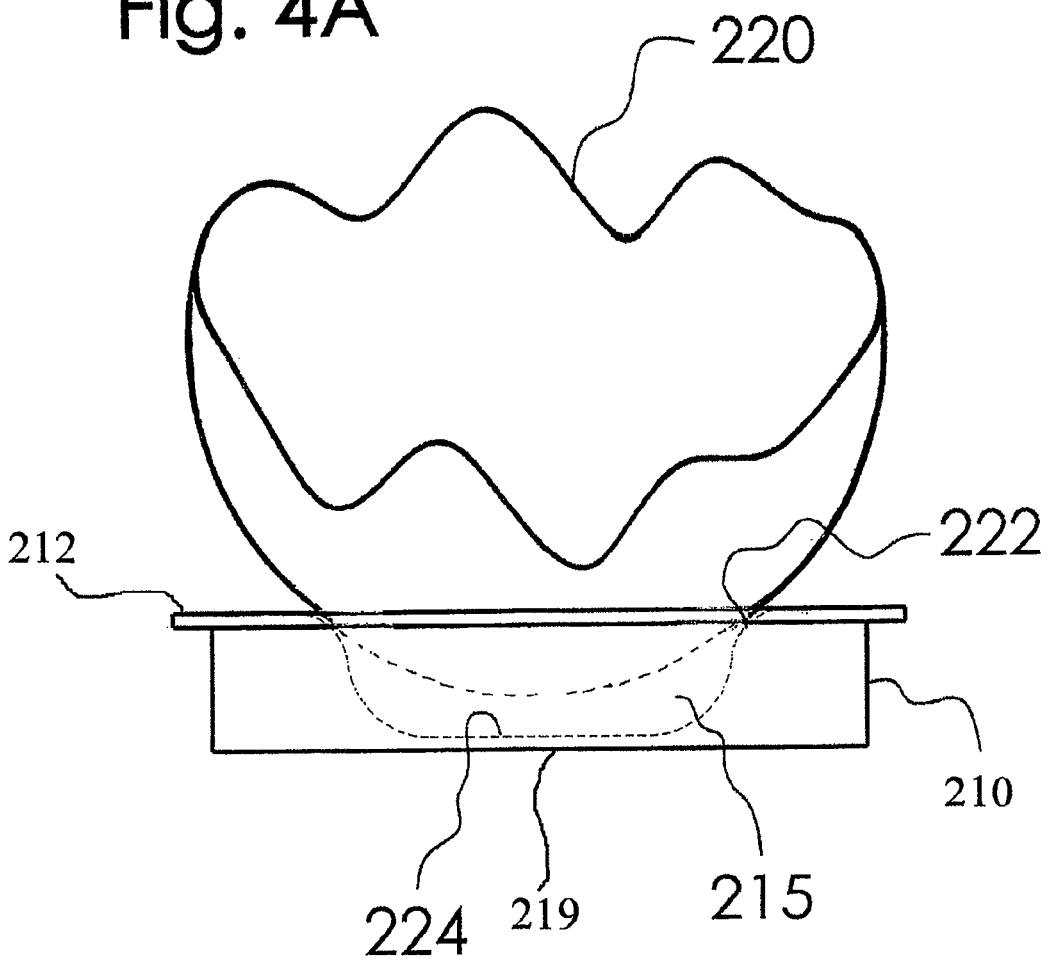
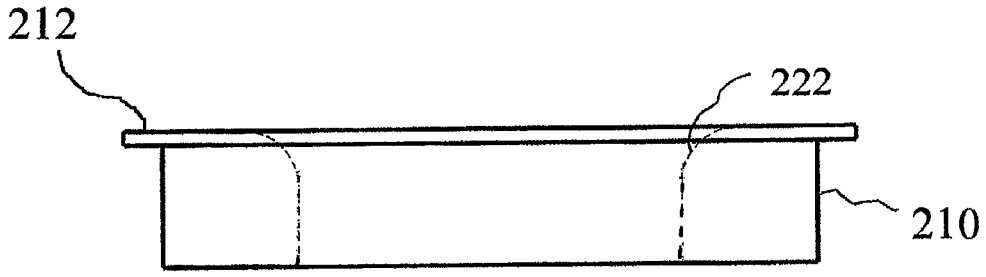
Fig. 4B

Fig. 5A
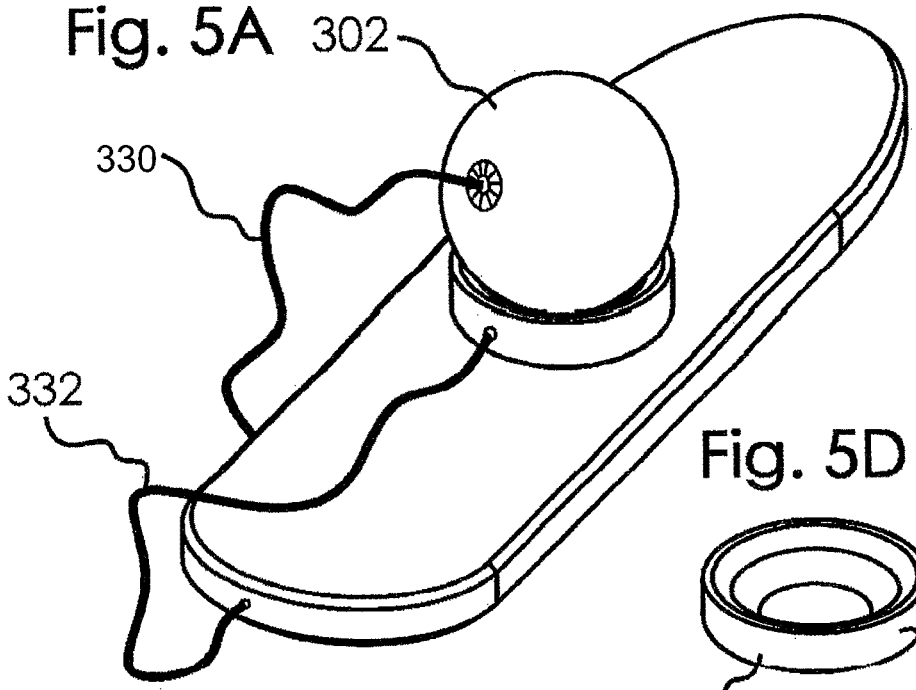
Fig. 5D
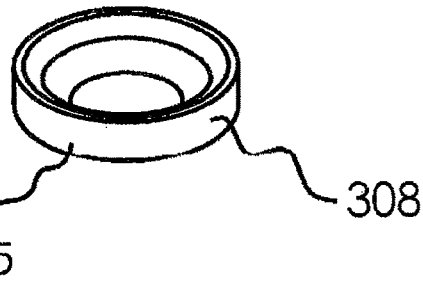
Fig. 5C
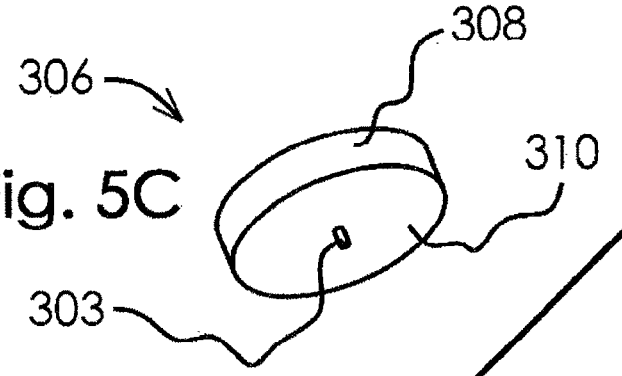
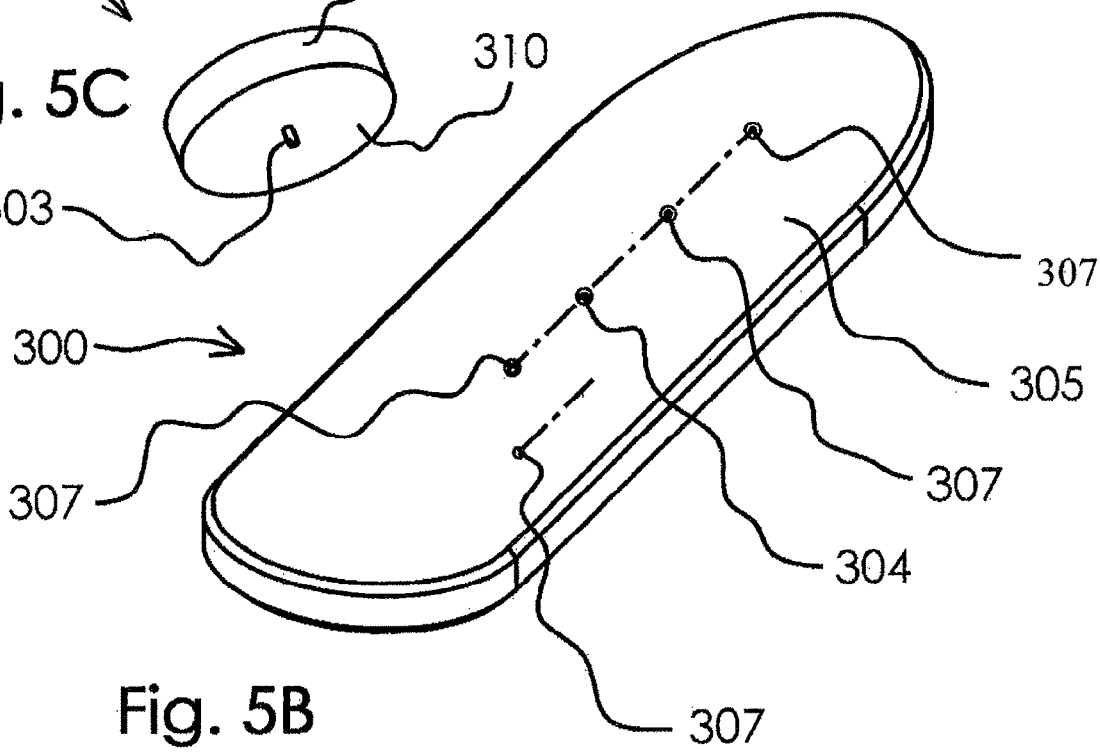
Fig. 5B

YOGA BALL PADDLEBOARD

CROSS-REFERENCE TO RELATED APPLICATION

This application claims the benefit of U.S. Provisional Application Ser. No. 62/493,765, filed Jul. 14, 2016, and is a continuation-in-part of U.S. patent application Ser. No. 14/977,630, filed Dec. 21, 2015, which claims the benefit of U.S. Provisional Application Ser. No. 62/124,451, filed Dec. 19, 2014, which applications are incorporated by reference herein in their entirety.

BACKGROUND

The present invention relates floatation devices, and more particularly to a floatation device including a yoga ball for performing yoga ball exercises while floating on a body of water.

Yoga has been practiced for thousands of years and has become an increasingly popular form of exercise. Among its many benefits, yoga can lessen chronic pain, such as lower back pain, arthritis, and headaches. Yoga may also lower blood pressure and reduce insomnia. Physical benefits of yoga include increased flexibility and increased muscle strength and tone.

Among the many forms of yoga, paddle board yoga is a variation of stand up paddleboarding, combined with yoga. Yoga poses are performed on a paddle board and the like while floating on water. Since the platform is unstable, the core muscle must be engaged for better balance. The entire midsection must be strengthened to maintain balance on the floating board.

SUMMARY

A yoga paddleboard may include a yoga board body having a hole extending therethrough. The hole may be formed at the approximate lateral and longitudinal center of the paddleboard. The hole may be sized and configured to support a yoga ball pressed in the hole to establish an interfacing friction connection therebetween. The yoga ball may be used to perform yoga exercises while floating on the paddleboard. Alternative embodiments may include yoga ball supports configured to support yoga balls of different sizes and/or multiple yoga balls on the paddleboard.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

FIG. 1 is a perspective view of a yoga paddleboard and a yoga ball supported on the yoga paddleboard.

FIG. 2A is a perspective of the yoga paddleboard of FIG. 1 without the yoga ball.

FIG. 2B is a perspective view of a cap covering for the yoga paddleboard of FIG. 1.

FIG. 4A is a partial cross section view of a yoga ball support insert.

FIG. 4B is a partial cross section view of a yoga ball support insert with an open bottom end.

FIG. 5A is a perspective view of a third embodiment of a yoga paddleboard.

FIG. 5B is a perspective view of the yoga paddleboard of FIG. 5A including multiple holes for mounting multiple yoga ball supports on the paddleboard of FIG. 5A.

FIGS. 5C and 5D are perspective views of yoga ball supports for use with the yoga paddleboard of FIG. 5A.

DETAILED DESCRIPTION

Figures 3A, 3B, 3C, 3D, 3E, 3F, 3G:
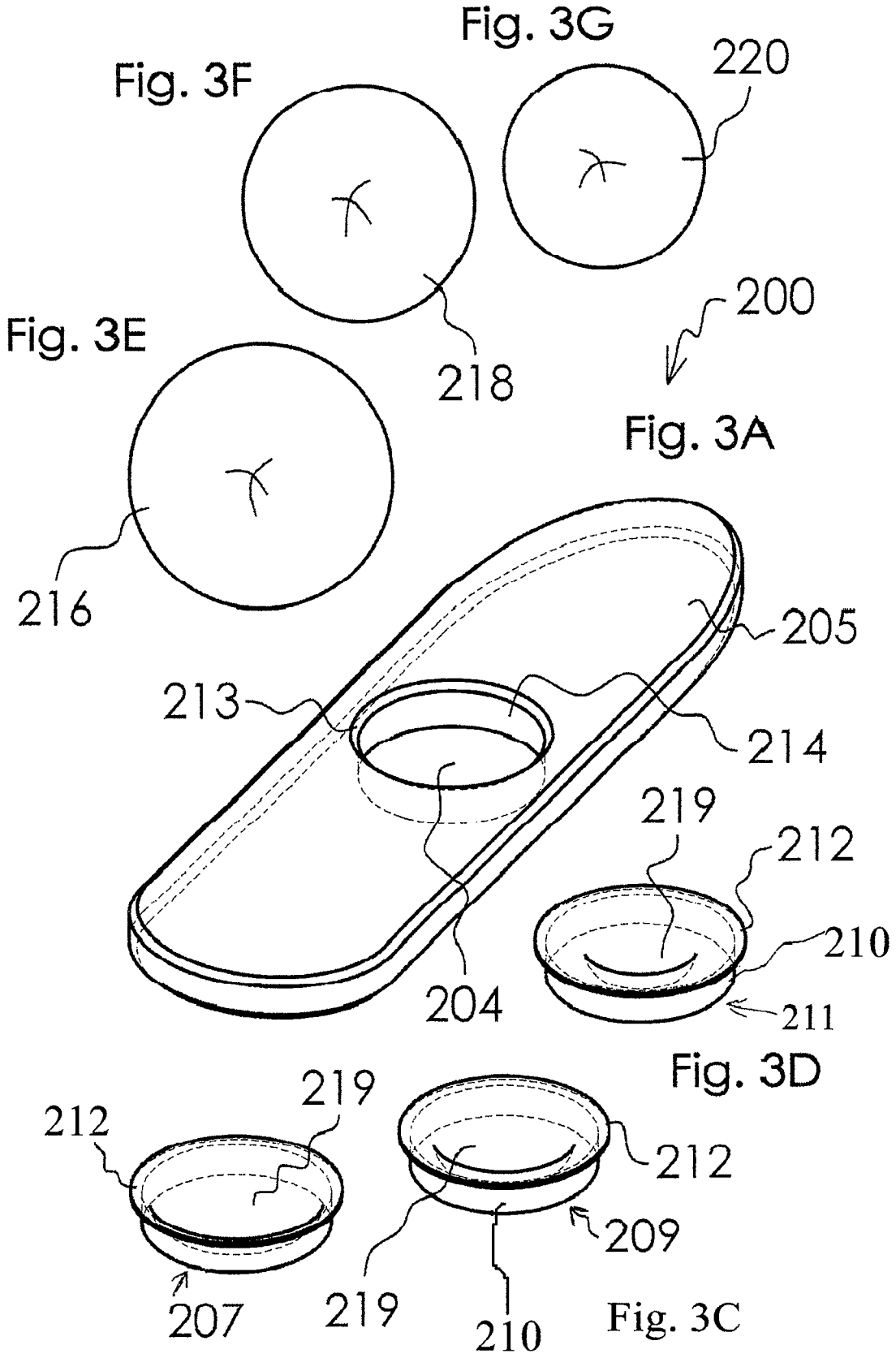
FIG. 3A is a perspective view of a second embodiment of a yoga paddleboard.
FIGS. 3B-3D are perspective views of yoga ball support inserts that may be used with the yoga paddleboard of FIG. 3A.
FIGS. 3E-3G are perspective views of different sized yoga balls.

Referring first to FIGS. 1 and 2, a paddleboard 100 is shown with a yoga ball 102 supported in a hole 104 formed in the paddleboard 100. The board 100 may include a board body 105 constructed of wood, urethane or EPS foam with fiberglass or carbon fiber shell, blow molded or roto molded, or by other methods known in the art such that the board 100 is sufficiently buoyant to support a user thereon. The hole 104 may be located at approximately the lateral and longitudinal center of the board 100. The hole 104 may be sized to accommodate a yoga ball 102 of a predetermined size and diameter but the diameter of the hole 104 may be smaller than the diameter of the yoga ball 102. The yoga ball 102 may be pressed into the hole 104 so that the yoga ball 102 defects inwardly at the point of contact with the hole 104 a portion of the yoga ball 102 extends into the hole 104. Friction at the point of contact holds the yoga ball 102 in place on the board 100.

The board 100 may be used for various activities including, but not limited to, paddle board yoga, stand up paddleboarding and surfing. When the board 100 is not used for paddle board yoga, a cap 106 may be inserted in the hole 104. The cap 106 may include a top planar surface 108 and a plug 110 extending downward therefrom. The plug 110 may be sized and configured to the shape of the hole 104, thereby establishing a friction fit connection with the board 100. The diameter of the top surface 108 of the cap 106 may be greater than the diameter of the plug 110 so that the top surface 108 includes an overhanging region or flange 112 extending radially outwardly beyond the outer surface of the plug 110. Upon assembly with the board 100, the flange 112 may rest on of the top surface of the board 100 and thereby sealing off the hole 104. Alternatively, a counterbore 114 may be formed to enlarge the upper end of the hole 104. The counterbore 114 may be sized and shaped to receive the flange 112 so the top surface 108 of the cap 16 is flush with the top surface of the board 100. In this configuration, the board 100 may be used for paddleboarding, surfing and the like.

Referring now to FIGS. 3A-3G, a second embodiment of a paddleboard is generally identified by reference numeral 200. The paddleboard 200 may include a board body 205 constructed of wood, urethane or EPS foam with fiberglass or carbon fiber shell, blow molded or roto molded, or by other methods known in the art such that the paddleboard 200 is sufficiently buoyant to support a user thereon. The paddleboard 200 may include a hole 204 located at approximately the lateral and longitudinal center of the board 200. The hole 204 may be sized and shaped to receive inserts 207, 209, 211 configured to accommodate yoga balls of different sizes. The hole 204 may extend through the yoga board body 205. An inwardly extending beveled edge 213 may extend from the top surface of the yoga board body 205 to a substantially vertical sidewall 214 of the hole 204. The inserts 207, 209, 211 may include an angularly extending lip 212 and a sidewall 210 (or sidewalls if the shape is non-cylindrical) projecting downwardly from the lip 212. The angle of the lip 212 may correspond to the angle of the beveled edge 213 for mating engagement therewith. The lower ends of the inserts 207, 209, 211 may be closed by a transverse bottom wall 219.

Upon insertion in the hole 204, the upper edge of the lip 212 of the inserts 207, 209, 211 may be flush with the top surface of the yoga board body 205. The inserts 207, 209, 211 may include radiused depressions 215 sized to accommodate different size yoga balls 216, 218, 220. The depressions 215 may be defined by an inwardly sloping circumferential sidewall 222 and a generally horizontal bottom wall 224, best shown in FIG. 4A. Typically, yoga balls are sized for use by users of different heights. During normal use for example, a 45 cm diameter yoga ball would be used by individuals less than 5' feet tall, a 55 cm diameter yoga ball by individuals 5' to 5'5" tall, a 65 cm diameter yoga ball by individuals 5'6" to 6' tall, a 75 cm diameter yoga ball by individuals 6' to 6'5" tall, and an 85 cm diameter yoga ball by individuals more than 6'5" tall. For the convenience of a user, the respective yoga balls 216, 281, 220 may be matched with respective inserts 207, 209, 211 and may be color coordinated such that the yoga balls and inserts are matched with similar colors. Any number of different sized yoga balls and inserts may be used with the yoga paddleboard 200, it being understood that the three sizes of yoga balls and inserts shown in FIGS. 3B-3G is for illustrative purposes and not by limitation.

Alternatively, the insets 207, 209, 211 may be open at the bottom end thereof, shown in FIG. 4B, so that the yoga balls may be partially supported by buoyancy forces.

Referring now to FIGS. 5A and 5B, a third embodiment of a yoga ball paddleboard is generally identified by the reference numeral 300. The paddleboard 300 may include a longitudinal body 305 constructed of wood, urethane or EPS foam with fiberglass or carbon fiber shell, blow molded or roto molded, or by other methods known in the art such that the paddleboard 300 is sufficiently buoyant to support a user thereon. The paddleboard 300 may include a centering hole 304, shown in FIG. 5B. The hole 304 may be sized to receive a post 303 projecting downwardly from the bottom of the yoga ball support 306. The yoga ball support 306 is similar to the inserts 207, 209, 211 described above with reference to the paddleboard 200. The yoga ball support 306 may include a sidewall or sidewalls 308 extending upwardly from a substantially horizontal bottom wall 310. The yoga ball support 306 may include a radiused depression 315 sized to accommodate a yoga ball 302.

The yoga ball board 300 may include multiple holes for mounting multiple yoga ball supports 306 on the yoga ball board 300. In addition to the hole 304, the yoga board 300 may include holes 307 longitudinally aligned with and/or laterally offset from the hole 304. The yoga ball 302 may therefore be supported fore or aft and/or laterally on the yoga board 300 as may be required by a yoga exercise. Two or more yoga balls 302 may be supported by yoga board supports 306 as may be desired in the performance of a yoga exercise.

The depressions 315 that center and support the yoga balls 302 may include radiused edges as described above with reference to the radiused depressions 215 of the yoga board 200. Alternatively, the ball supports 306 may be similar to the insert 206 of the yoga board 200 where the bottom of the ball supports 306 is open and the yoga balls 302 are supported on a beveled edge forming the open upper end of the ball supports 306. A tethering cord 330 may connect the yoga ball 302 to the yoga board 300 and a tethering cord 332 may connect the yoga board support 306 to the yoga board 300.

Figure 6:
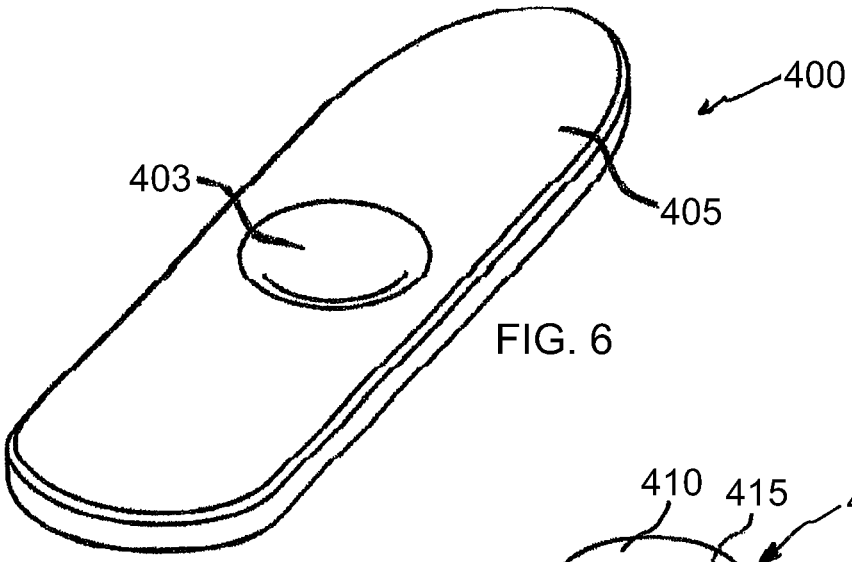
FIG. 6 is a perspective view of a fourth embodiment of a yoga ball paddleboard.
Figure 7B:
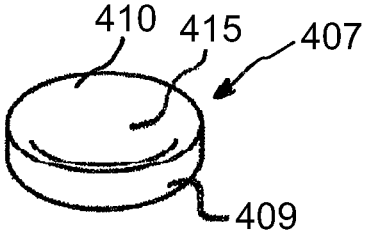
FIG. 7B is a top perspective view of a yoga ball support insert for use with the paddleboard shown in FIG. 6.
Figure 7A:
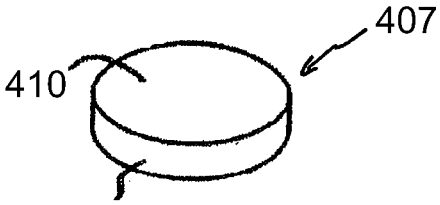
FIG. 7A is a bottom perspective view of a yoga ball support insert for use with the paddleboard shown in FIG. 6.

Referring now to FIG. 6, a fourth embodiment of paddleboard is generally identified by the reference numeral 400. The paddleboard 400 may include a board body 405 constructed of wood, urethane or EPS foam with fiberglass or carbon fiber shell, blow molded or roto molded, or by other methods known in the art such that the paddleboard 400 is sufficiently buoyant to support a user thereon. The paddleboard 400 may include a blind hole 404 located at approximately the lateral and longitudinal center of the paddleboard 400. The blind hole 404 may extend partially through the body 405 of the paddleboard 400 and terminate at a horizontally extending bottom wall 403. The hole 404 may be sized and shaped to receive an insert 407, shown in FIGS. 7A and B, configured to support a yoga ball on the paddleboard 400. The insert 407 may be sized and configured to be received in the blind hole 404 and include substantially planar top and bottom surfaces 410, 411 separated by a perimeter wall 409. A yoga ball may be center in an indentation or depression 415 formed in top surface 411 of the insert 407. In the event, a yoga ball is not supported by the insert 407, it may be turned over so that the bottom surface 411 faces upward and thereby provide a flat surface lying in the same plane as the top of the body 405 of the paddleboard 400.

Figure 8:
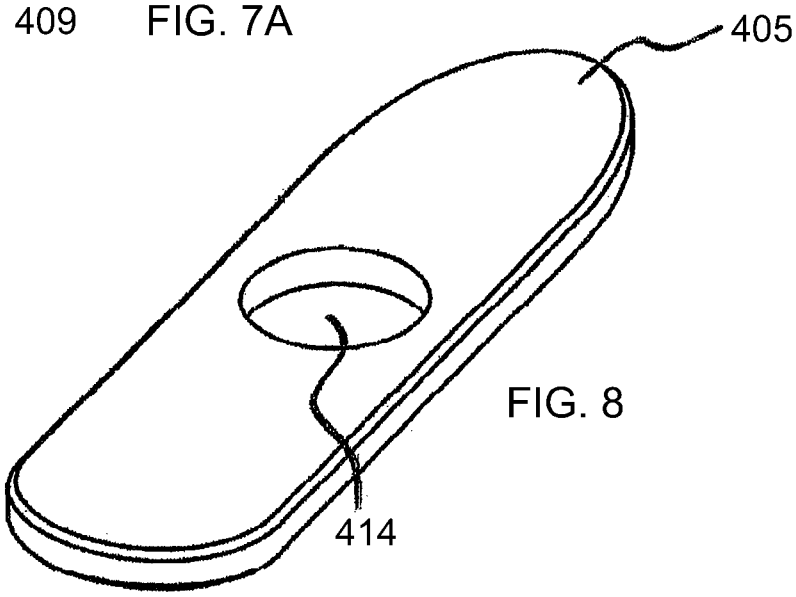
FIG. 8 is another perspective view of the paddleboard shown in FIG. 6.
Figure 11:
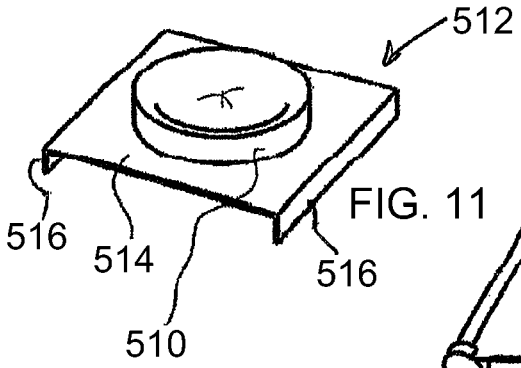
FIG. 11 is a perspective view of a yoga ball support platform for use with the paddleboard shown in FIG. 9.
Figure 12:
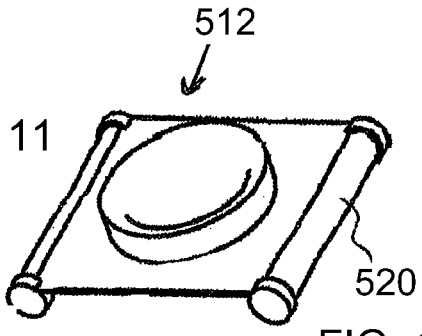
FIG. 12 is a perspective view of the yoga ball support platform shown in FIG. 11 depicting pontoons secured to the yoga ball support platform.
Figure 9:
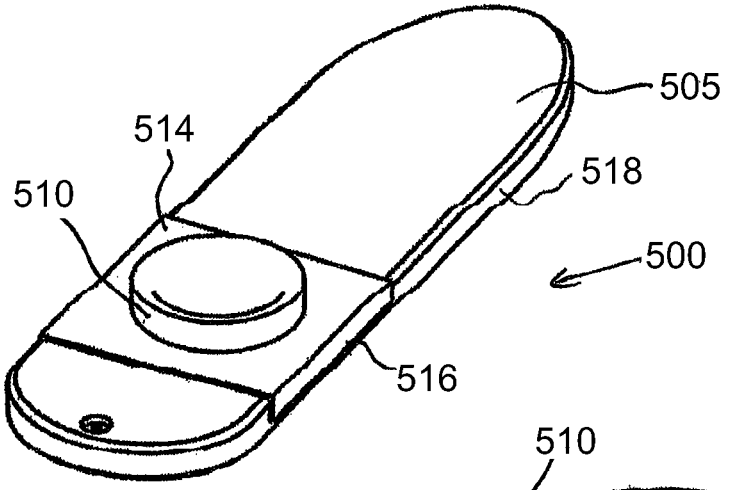
FIG. 9 is a perspective view of a fifth embodiment of a yoga ball paddleboard.
Figure 10:
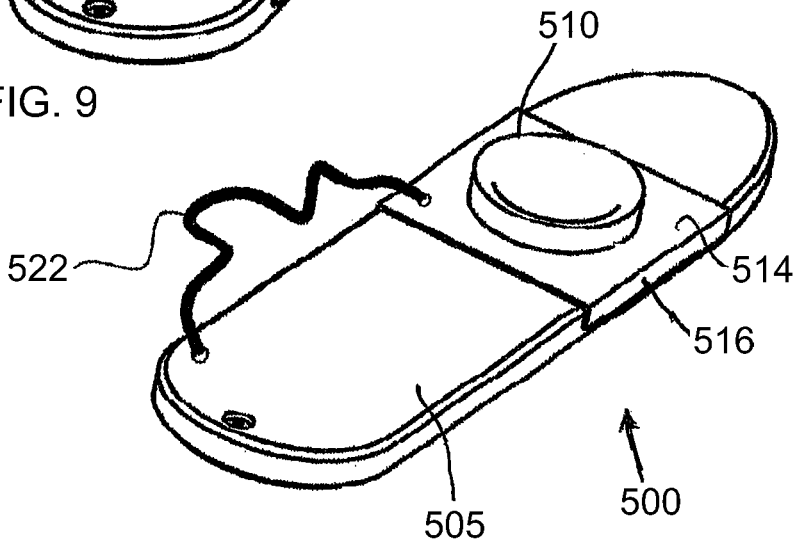
FIG. 10 is a perspective view of the paddleboard shown in FIG. 9 depicting a yoga ball support platform at an aft position.

In some instances, the paddleboard 400 may include a hole 414 extending through the body 405 of the paddleboard 400, shown in FIG. 8. The insert 407 may be fabricated from a clear plastic material so that a user may see into the water depths below through the insert 407 inserted into the hole 414. The insert 407 may include an air chamber and the like so that it may be independently buoyant.

Directing attention now to FIGS. 9-12, a fifth embodiment of a yoga ball paddleboard is generally identified by the reference numeral 500. The paddleboard 500 may include a board body 505 constructed of wood, urethane or EPS foam with fiberglass or carbon fiber shell, blow molded or roto molded, or by other methods known in the art such that the paddleboard 500 is sufficiently buoyant to support a user thereon. A ball support 510 may be movably mounted on the body 505 of the paddleboard 500. The ball support 510 may be secured on a platform 512 comprising a substantially flat surface 514 having sidewalls 516 extending downwardly from the lateral edges of the surface 514. The width of the platform 512 may be slightly greater than the transverse dimension of the paddleboard 500 so that the sidewalls 516 slidably engage the rails 518 of the paddleboard 500. The platform 512 may be moved longitudinally fore and aft relative to the body 505 of the paddleboard 500 as desired by the user.

The platform 512 may be fabricated of relatively light or buoyant materials so that it may float on the water surface in the event platform 512 is separated from the paddleboard 500. Alternatively, the platform 512 may be provide with pontoons 520 of sufficient size to provide independent buoyancy for the platform 512. A tether 222 may connect the platform 512 to the paddleboard body 505.

Figure 13:
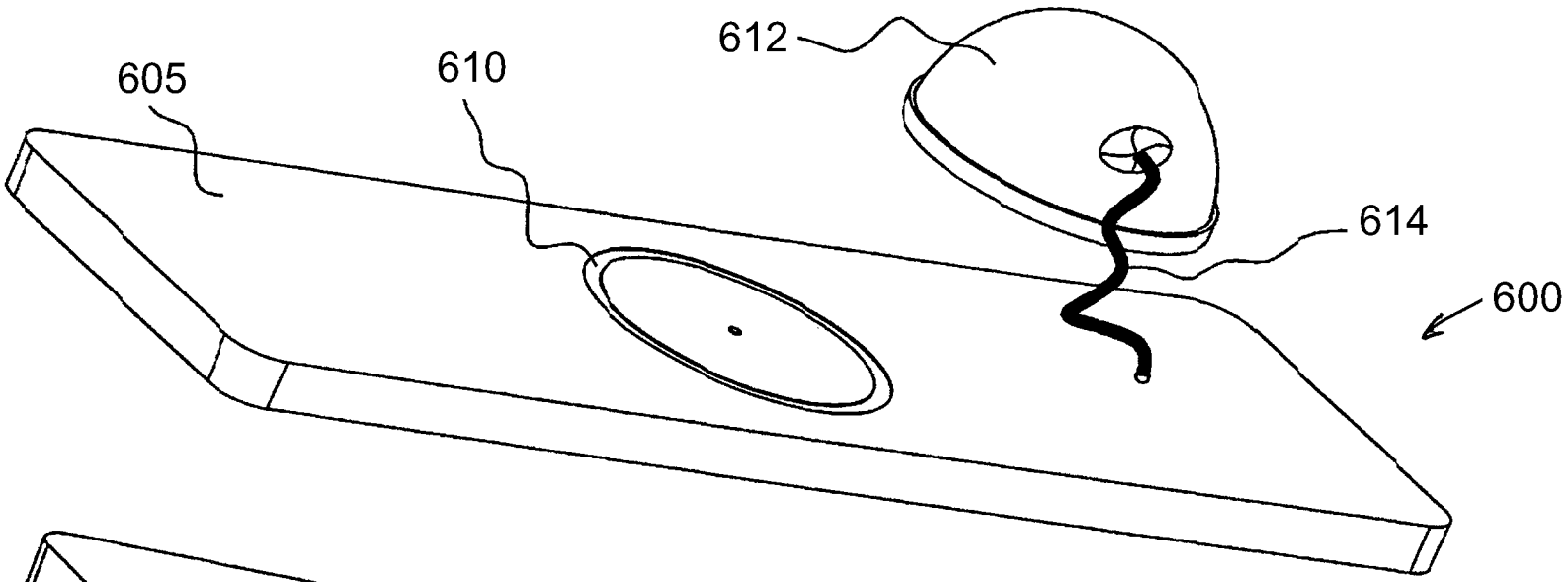
FIG. 13 is a perspective view of a sixth embodiment of a yoga ball paddleboard.
Figure 14:
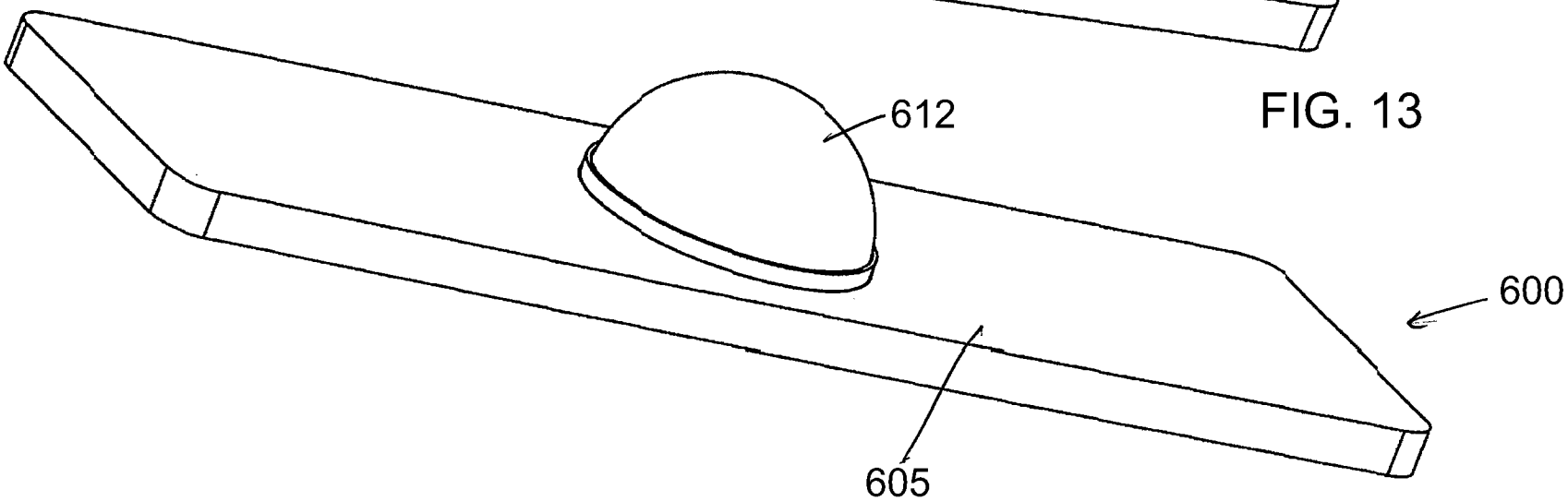
FIG. 14 is a perspective view of the yoga ball paddleboard shown in FIG. 13 depicting a hemispherical bladder supported on the paddleboard.

Referring now to FIGS. 13 and 14, a sixth embodiment of a yoga ball paddleboard is generally identified by the reference numeral 600. The paddleboard 600 may include a board body 605 constructed of wood, urethane or EPS foam with fiberglass or carbon fiber shell, blow molded or roto molded, or by other methods known in the art such that the paddleboard 600 is sufficiently buoyant to support a user thereon. The paddleboard 600 may include a groove 610 located at approximately the lateral and longitudinal center of the paddleboard 600. The groove 610 may be relatively shallow and shaped to mate with the bottom profile of a ball support and the like. In FIGS. 13 and 14, for purposes of illustration but without limitation, the groove 610 is configured to mate with a bottom edge of a hemispherical bladder 612. A tether 614 may connect the hemispherical bladder 612 to the body 605 of the paddleboard 600.

While preferred embodiments of the invention have been shown and described, other and further embodiments of the invention may be devised without departing from the basic scope thereof, and the scope thereof is determined by the claims which follow.

The invention claimed is:

1. A floatation device, comprising:

a) an elongated buoyant body having a center longitudinal dimension and a transverse dimension, wherein the center longitudinal dimension is greater than the transverse dimension;

b) the elongated buoyant body including a hole at an intersection of the center longitudinal dimension and the transverse dimension, the hole extending through the elongated buoyant body;

c) a first removable insert having an open top end and a closed bottom end, the first removable insert including a lip extending outward from a sidewall of the first removable insert, the first removable insert including a radiused depression; and d) a ball removably supported by the first removable insert, the ball having a diameter greater than the open top end of the first removable insert.

2. The floatation device of claim 1, further comprising a plurality of other removable inserts different from the first removable insert, each of the plurality of other removable inserts configured for cooperative engagement with the hole extending through the elongated buoyant body.

3. The floatation device of claim 2, wherein each of the plurality of other removable inserts includes an open bottom end.

4. The floatation device of claim 1, further comprising a cap configured for closing an upper end of the hole.

5. The floatation device of claim 4, wherein a top surface of the cap is flush with a top surface of the elongated buoyant body when the cap closes the upper end of the hole.

* * * * *